United States Patent [19]

Novik et al.

[11] Patent Number: 4,972,182

[45] Date of Patent: Nov. 20, 1990

[54] ELECTRONIC SECURITY LOCK

[75] Inventors: Avraham Novik, Givataim; Mordechai Aharoni, Ramat-Gan; Shimon Aharoni, Bat-Yam, all of Israel

[73] Assignee: A. A. Computerized Security Doors 1989 Ltd., Tel Aviv, Israel

[21] Appl. No.: 259,862

[22] Filed: Oct. 19, 1988

[30] Foreign Application Priority Data

Oct. 27, 1987 [IL] Israel ..... 84296

[51] Int. Cl.[5] ..... G08B 5/00

[52] U.S. Cl. ..... 340/825.32; 340/825.31; 70/278; 361/172

[58] Field of Search ..... 340/825.31, 825.32, 340/542, 543; 70/277, 278; 361/172; 235/382, 382.5; 292/114, 201

[56] References Cited

U.S. PATENT DOCUMENTS

| | | | |
|---|---|---|---|
| 3,889,501 | 6/1975 | Fort | 361/172 |
| 4,209,782 | 6/1980 | Donath et al. | 70/278 |
| 4,392,133 | 7/1983 | Lundgren | 340/825.31 |
| 4,558,175 | 12/1985 | Genest et al. | 340/825.34 |
| 4,642,631 | 2/1987 | Rak | 340/825.31 |
| 4,646,080 | 2/1987 | Genest et al. | 340/825.31 |
| 4,677,284 | 6/1987 | Genest | 340/825.31 |
| 4,712,398 | 12/1987 | Clarkson et al. | 70/278 |

*Primary Examiner*—Donald J. Yusko
*Assistant Examiner*—Edwin C. Holloway, III
*Attorney, Agent, or Firm*—Benjamin J. Barish

[57] ABSTRACT

An electronic door locking apparatus includes a key containing a first memory for storing a first code, and an electronic lock having a receptacle for receiving and reading the first code, a locking mechanism actuatable to a locking or unlocking condition, and a control system for controlling the locking mechanism in response to the insertion of a key into the receptacle. The control system includes a second memory for storing a second code, detectors for detecting whether the door is open or closed, a New-Code control member actuatable by the user when a new code is to be generated, and a Copy-Code control member actuable by the user when the code in the control system is to be copied into the memory of another key inserted into the receptacle.

18 Claims, 3 Drawing Sheets

ELECTRONIC SECURITY LOCK

BACKGROUND OF THE INVENTION

This invention relates to an integrated electronic security lock employing an electronic key which may be encoded by means of a control system coupled to the lock.

Various systems exist in the prior art for providing high security access to buildings. Generally, there is a trade-off in such systems between flexibility and security, whereby the most secure systems are relatively inflexibile. Thus, for example, in one system the finger prints of all authorised entrants are programmed into a computer, and an optical reader coupled to the computer is adapted to read the finger prints of people seeking access to the building, permitting entry only to those whose finger prints are stored in the computer memory. Such a system provides high security but is too inflexible to be serviceable for domestic premises, for example. Magnetic card keys also exist wherein a secret number is magnetically stored on the card, similar to the system employed in bank service cards. The user inserts the card into a suitable receptacle, and enters his personal code via a computer keyboard. Access will be granted only if the code thus entered corresponds to that stored magnetically on the card key. Such systems require the user to remember his personal code, and this effectively limits the total number of permutations of the code digits and, therefore, the security of the code. Thus, for example, if the code has only four digits, then the maximum number of permutations of the code is 10 000, assuming that each digit can have any value from 0 to 9. Moreover, such magnetic key cards may only be copied or encoded using special equipment which generally puts them out of the range of the domestic market.

Hotel security systems are also known which employ magnetic coded key cards, the security system comprising a computerized control unit by means of which the code corresponding to each hotel room may easily be changed.

OBJECTS AND BRIEF SUMMARY OF THE INVENTION

One object of the present invention is to provide an electronic door locking apparatus enabling the user to change the code in a very convenient manner whenever desired.

Another object of the invention is to provide an electronic door locking apparatus enabling the user to copy the code into other keys in a convenient manner whenever desired.

A further object of the invention is to provide an electronic door locking apparatus having protection against loss of the stored code in the event of interruption of power to the control system.

A still further object of the invention is to provide an electronic door locking apparatus which is suitable for both commercial and domestic premises.

According to one aspect of the present invention, there is provided an electronic door locking apparatus comprising a key containing a first memory for storing a first code; and an electronic lock carried by the door and having a receptacle for receiving the key and for reading the first code, a locking mechanism actuatable to a locking or unlocking condition, and a control system for controlling the locking mechanism in response to the insertion of the key into the receptacle. The control system comprises a second memory for storing a second code; a New-Code control member disposed inwardly of the door and actuatable by the user when a new code is to be generated; comparison means for comparing the first code stored in the first memory of the key with the second code stored in the second memory of the control system, to determine whether a match exists; key detector means for detecting whether a key is inserted into the receptacle; and door detector means for detecting whether the door is open or closed. The control system further includes a processor programmed so as to be effective, if (a) the key is inserted into the receptacle as detected by the key detector means, (b) the first code stored in the first memory of the inserted key matches the second code stored in the second memory of the control system as determined by the comparison means, (c) the door is open as determined by the door detector means, and (d) the New-Code control member is actuated, then to generate a new code and to store same in the first memory of the inserted key and in the second memory of the control system.

According to another feature of the invention, the control system further includes a Copy-Code control member disposed inwardly of the door and actuatable by the user when the second code in the memory of the control system is to be copied into the memory of another key. The processor is further programmed so as to be effective, if (a) a key is inserted into the receptacle as detected by the key detector means, (b) the first code stored in the first memory of the inserted key matches the second code stored in the second memory of the control system as determined by the comparison means, (c) the door is open as determined by the door detector means, and (d) the Copy-Code control member is actuated, then to copy the second code stored in the second memory of the control system into the first memory of another key subsequently inserted into the receptacle.

According to a further feature in the described preferred embodiment, the control system further includes lock detector means for detecting whether the locking mechanism is in its locking or unlocking position, and a Lock-Unlock control member disposed inwardly of the door and actuatable by the user. The processor is further programmed so as to be effective when the Lock-Unlock control member has been actuated, to actuate the locking mechanism to its locking condition if then in the unlocking condition, or to its unlocking condition if then in the locking condition.

According to a still further feature in the described preferred embodiment, the control system includes a read-only-memory storing a basic code. The processor is further programmed so as to be effective, upon the interruption and restoration of power to the control system, automatically to store the basic code in the second memory of the control system.

According to a still further feature in the described preferred embodiment, the locking mechanism comprises at least one locking bolt carried by the door and receivable in a socket in the door frame, a rotary motor carried by the door, and a transmission coupling the rotary motor to the locking bolt to drive it into or out of the socket.

Further features of the invention will be apparent from the description below.

Preferably, the electronic key is a sealed unit containing a NOVRAM (non-volatile random access memory) powered by an internal lithium cell, which NOVRAM is able to store information in the event of power failiure. The key is provided with external pins for coupling to the security lock control circuit via a suitable receptacle provided therein. The key pins include pins for providing power to the key as well as writing data thereto and reading data therefrom. Additionally, one pin permits connection of a clock synchronizing signal and another pin is used in order to reset the NOVRAM. Thus, a code may be stored indefinitely in the key and may be read by the security lock control circuit which is also adapted to write a new code to the key.

In one prefered embodiment the key device provided, is divided into three major parts, of which the first two are password areas allowing (or alternatively preventing) access to the key; and the last part is the actual storage of the active system codes. The said active code area is divided into four zones (or any other required number of zones), having a zone A of highest priority, followed by a zone B of secondary priority and so on; so that when the key is entered into any coded system, the system will search for the appropriate code zone on the key and will react according to the preset priority; so that the zones A through D will not open door systems, only the highest priority key will open all the systems.

Each of the said systems could generate new system codes, effecting only the portion of the active code zone in that particular system leaving all the other code zones intact.

A control panel situated within the premises permits the owner of the premises to lock and unlock the door from the inside, without using the key. Other functions may also be activated by inserting a valid key into the key receptacle, following which the user may request the control circuit to generate a new code for subsequent storage within the key, whose secret code is thereby immediately changed. The computing means is preferably constituted by a microprocessor containing an "active" code which, at the request of the user, may automatically be copied to any number of other keys.

In a preferred embodiment, an audio monitoring system is provided which produces an audio feedback signal in response to each procedure performed by the user. Thus, for example, in response to inserting a key into the receptacle, the connection is acknowledged by an audio signal which continues to sound until the key is removed, thereby cautioning the user against leaving his key in the receptacle inadvertently.

Preferably, there is also coupled to the security lock a comprehensive alarm system which is adapted to prevent the user from locking the premises from the outside whilst access is still available to the building through open windows and so on. The alarm will also sound if an invalid key is inserted into the receptacle or if the lock mechanism is interfered with.

Also built into the system is a series of power failure safety features. Within the premises, the user is provided with mechanical means for unlocking the door independent of the motor mechanism, in the event of a power failiure. Relatively short power failures have no adverse effect on the control systems, since this is provided with automatic recharegable battery back-up. The battery back-up is maintained fully charged via the mains supply, and operates automatically in the event of mains power failure. In the unlikely event of complete power failure for a prolonged period of time, such that the active code is effectively erased from the microprocessor memory, a basic code stored within an EPROM (Eraseable Programmable Read Only memory) is automatically written to the microprocessor memory as soon as the power is returned. The user is then able to gain access to the premises by means of a seperate key programmed with the same basic code, and is then able to generate a new active code which can be copied to any number of other keys.

The microprocessor memory storing the active code and the memory within the key contain 256 bits of information. Thus, the total number of permutations is enourmous. It will thus be clear that the invention provides a high security access system which is nevertheless also highly flexible.

BRIEF DESCRIPTION OF THE DRAWINGS

The invention will now be described with regard to an integrated electronic security lock suitable for domestic premises and incorporating an intruder alarm system, with reference to the accompanying drawings in which.

DETAILED DESCRIPTION OF PREFERRED EMBODIMENT

Figure 1:
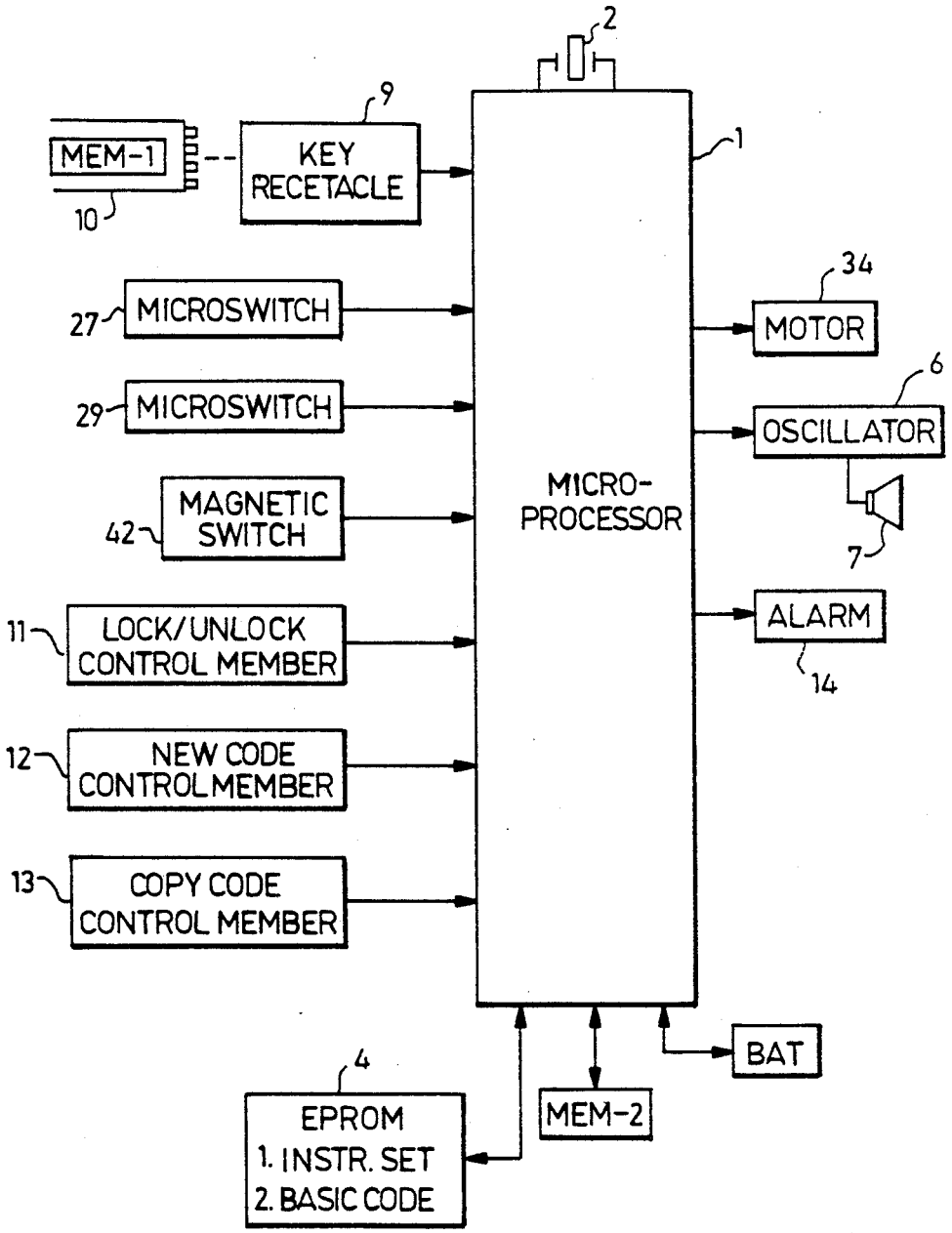
FIG. 1 is a block diagram showing functionally the main components of the system.

Referring to FIG. 1, there is shown a microprocessor 1 which derives its clock signals by means of an internal clock whose reference signals are provided by a quartz crystal 2. An instruction set for the microprocessor is stored in an EPROM 4 which is enabled by a chip enable pulse provided by the microprocessor 1. Connected to the microprocessor 1 is a local oscillator 6 coupled to a loudspeaker 7.

The local oscillator 6 is coupled to the microprocessor 1 so as to produce a variable frequency audible tone on the loudspeaker 7 in response to instructions from the microprocessor 1.

Also coupled to the microprocessor 1 is a key receptacle 9 which, in a preferred embodiment, contains five sockets into which corresponding pins of an external key 10 may be inserted. Three output lines from the microprocessor 1 are connected to a bank of three selector switches 1, 12, 13, to be described more particularly below, which permit selected instructions within the EPROM 4 to be initiated.

The microprocessor 1 is also connected to a lock mechanism which is fitted inside a door D (FIG. 2) movable to an open position or to a closed position with respect to a door frame F, and actuatable to a locking or unlocking condition when the door is in its closed position. Preferably, the microprocessor 1 is also coupled to an alarm 14 which is integrated within the system so as to render it secure. The alarm 14 may be a standard intruder alarm system provided with a plurality of sensors which monitor the status (i.e. locked or unlocked) of selected doors and windows within the building. Such alarm systems generally have "safe" and "unsafe" states corresponding, respectively, to the situation wherein all the monitored entrances are locked and to that where at least one entrance is unlocked. The alarm system 14 is so integrated with the control system, constituted by the microprocessors 1 and its associated circuitry, that the door may not be locked from the outside whilst the status of the alarm system is "unsafe".

Figure 2:
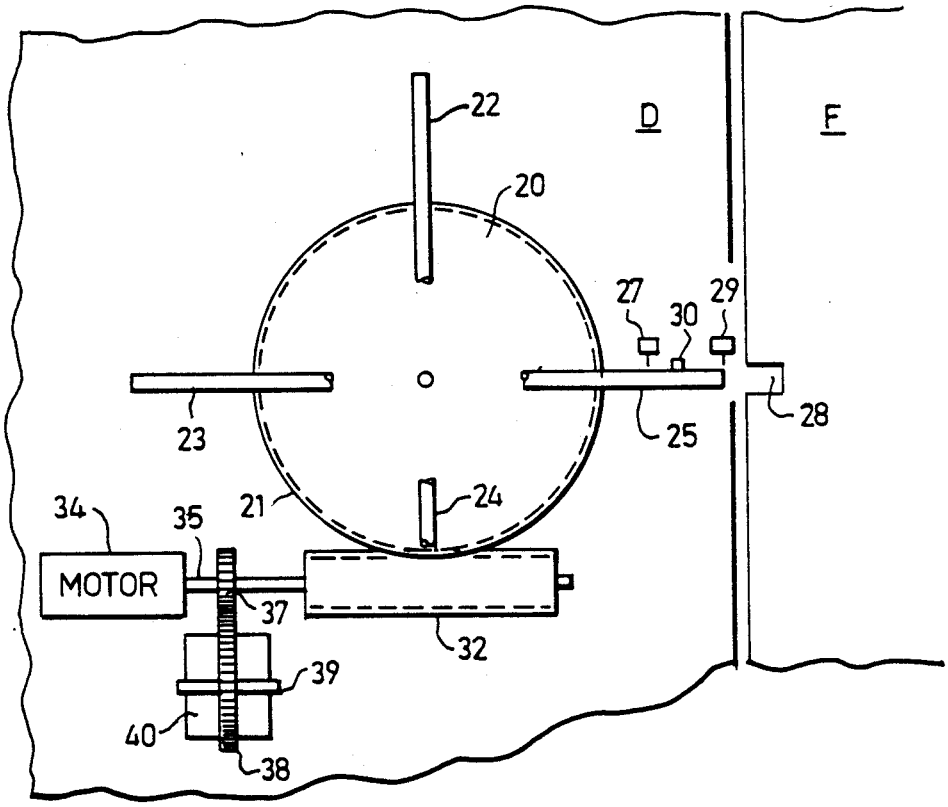
FIG. 2 shows in a simplified manner the door mechanism.

FIG. 2 shows a simplified mechanical arrangement of the lock mechanism carried by the door D. The lock mechanism is shown schematically by means of a drive wheel 20 provided with peripheral teeth 21. Locking bars 22, 23, 24 and 25 are so connected to the drive wheel 20 that they are either retracted or extended according to the direction of motion of the drive wheel 20. The number of locking bars and the exact mechanical arrangement by which they are operated is not a feature of the invention, it being important only that they can be adpated to operate from a single drive wheel.

Mounted adjacent to one of the drive locks 25 are two normally open microswitches 27 and 29 which are adapted to be closed via a small protrusion 30 so connected to the locking bar 25 that the microswith 27 is closed when the locking bar 25 is fully retracted within the door D and the microswitch 29 is closed when the locking bar is fully extended into a socket 28 in the door frame F. Thus, when the door is locked the microswitch 29 is closed and, conversely, when the door is unlocked the microswich 27 is closed.

The drive wheel 20 is rotated by means of a worm gear 32 driven by a motor 34 which is connected to the worm gear 32 by a shaft 35. Also mounted on the shaft 35 is a standard gear wheel 37 whose teeth mesh with the teeth of a second, larger, gear wheel 38 mounted on a shaft 39. A window 40 is provided on the internal surface of the door through which a part of the periphery of the gear wheel 38 protrudes.

The motor 34 is a compact, high power rotary electric motor and is connected to the microprocessor 1 via two lines which control the direction of rotation of the motor 34. The use of a worm gear 32 provides a high mechanical advantage and also prevents the drive wheel 20 from being rotated manually. The gear chain comprising gear wheel 37 and 38 is provided as a safety device in case the power to the motor 34 is interrupted. In this case, the gear wheel 38 may be turned manually through the window 40 from within the building, thereby turning the shaft 35 via gear wheel 37 and so turning the drive wheel 20 in a direction dependent upon the direction of rotation of the gear wheel 38. Thus, this provides a method of locking or unlocking the door manually from within the building in the event of a power failiure.

The two microswitches 27 and 29 are respectively coupled to the microprocessor 1 and provide a means of determining the status of the door (i.e. unlocked or locked). When the lock mechanism is operating there will be a small time interval wherein the protrusion 30 on the locking bar 25 is between the two microswitches 27 and 29. In this condition, both the microswitches 27 and 29 will be open. The microprocessor 1 is so programmed that if both the microswitches 27 and 29 are open for a period of time substantially greater than that taken for the lock mechanism to invert the status from locked to unlocked, or vice versa, the alarm 14 will become energised. The two microswitches 27 and 29 constitute status determination means which is adapted to discourage tampering with the system by a would-be intruder.

It is desirable to disable closure of the lock mechanism when the door is physically ajar, in order to prevent mechanical damage to the locking bars 22, 23, 24 and 25. The lower vertical bar 24, in particular, could be damaged by, or cause damage to, the floor, were it to be extended with the door open. In order to protect against this happening, a magnet switch 42 (FIG. 1) is located within the door frame so as to be operated when the door is closed. The magnet switch 42 is coupled to the microprocessor 1 which is adapted to prevent the lock mechanism from operating when the magnet switch indicates that the door is open.

The system is operated by inserting a valid key 10 into the key receptacle 9 shown in FIG. 1. The key itself is not a feature of the invention and any suitable device may be used which contains a memory MEM-1, e.g., a NOVRAM which can be written to, or read by, the microprocessor 1. In a preferred embodiment, the key is provided with five pins which engage the sockets of the key receptacle, so as to provide electrical contact with corresponding terminals in the key receptacle. One of the pins provides serial data communication between the key and the microprocessor. Of the remaining four pins, two provide the power supply to the key, one provides a clock signal for synchronizing the NOVRAM, and the fourth provides a reset signal for resetting the contents of the NOVRAM.

The selector switches 11, 12, 13 shown in FIG. 1 are three pushbutton switches located within the building. Switch 11, labelled LUCM (lock/unlock control member) In FIG. 1 permits the door to be locked or unlocked from within the building, whilst the other two pushbutton switches 12, 13 are adapted to function only when a valid key is present within the key receptacle 9. They are, moreover, responsive to the output signal from the magnet switch 42 indicating the condition of the door D, and are adapted to operate only when the door is open. Switch 12, labelled NCCM (new code control member) initiates a sequence of instructions within the instruction set, and permits a new code to be generated randomly and then used as the code stored in memory MEM-1 of the key within the key receptacle 9 so as to supersede its previous code. Switch 13, labelled CCCM (copy code control member) also initiates a sequence of instructions within the instruction set, so as to copy the current active code to as many keys as required.

The EPROM 4 contains the instruction set for operating the microprocessor 1, and retains the stored data even in the event of a power failure. The EPROM also contains a "basic" code which is stored within the NOVRAM of a corresponding "basic" key. Microprocessor 1 further includes a memory MEM-2 which stores the "valid" code to be compared by the microprocessor with the code stored in MEM-1 of the key 10 to determine whether the key is a valid one.

The system is provided with a rechargeable battery back-up 50, which supplies power to the system in the event of a mains power failure. In the event of a prolonged mains power failure, of sufficient duration that the battery back-up also becomes exhausted, the active code stored within the memory of the microprocessor 1 will be lost. Under such circumstances, even when the power to the system is restored, the "valid" key containing the active code stored in its memory RAM-1 will no longer operate the system, because the valid code contained therein no longer corresponds to that stored within memory MEM-2 of the microprocessor 1.

Therefore, the EPROM 4 also contains a power failure interrupt routine which is initiated in the event of total power failure to the system. The power failure interrupt routine is shown in the flow diagram of FIG.

3. Upon the interruption of power for a period sufficiently long to exhaust the back-up battery 50 so that the data within memory MEM-2 is lost, and the subsequent restoration of the power, the microprocessor 1 copies the basic code stored permanently within the non-volatile EPROM 4 to the memory MEM-2 of the microprocessor 1 containing the active code. A user may then activate the control system by entering a "basic" key containing the basic code into the key receptacle 9, since the basic key now functions as a valid key. the basic key must be secured in a safe place accessible to the user from outside the premises protected by the security lock of the present invention. Having gained entry to the building by means of the basic key, the user may then generate a new code and copy this new code to other keys as will now be described.

Figure 3:
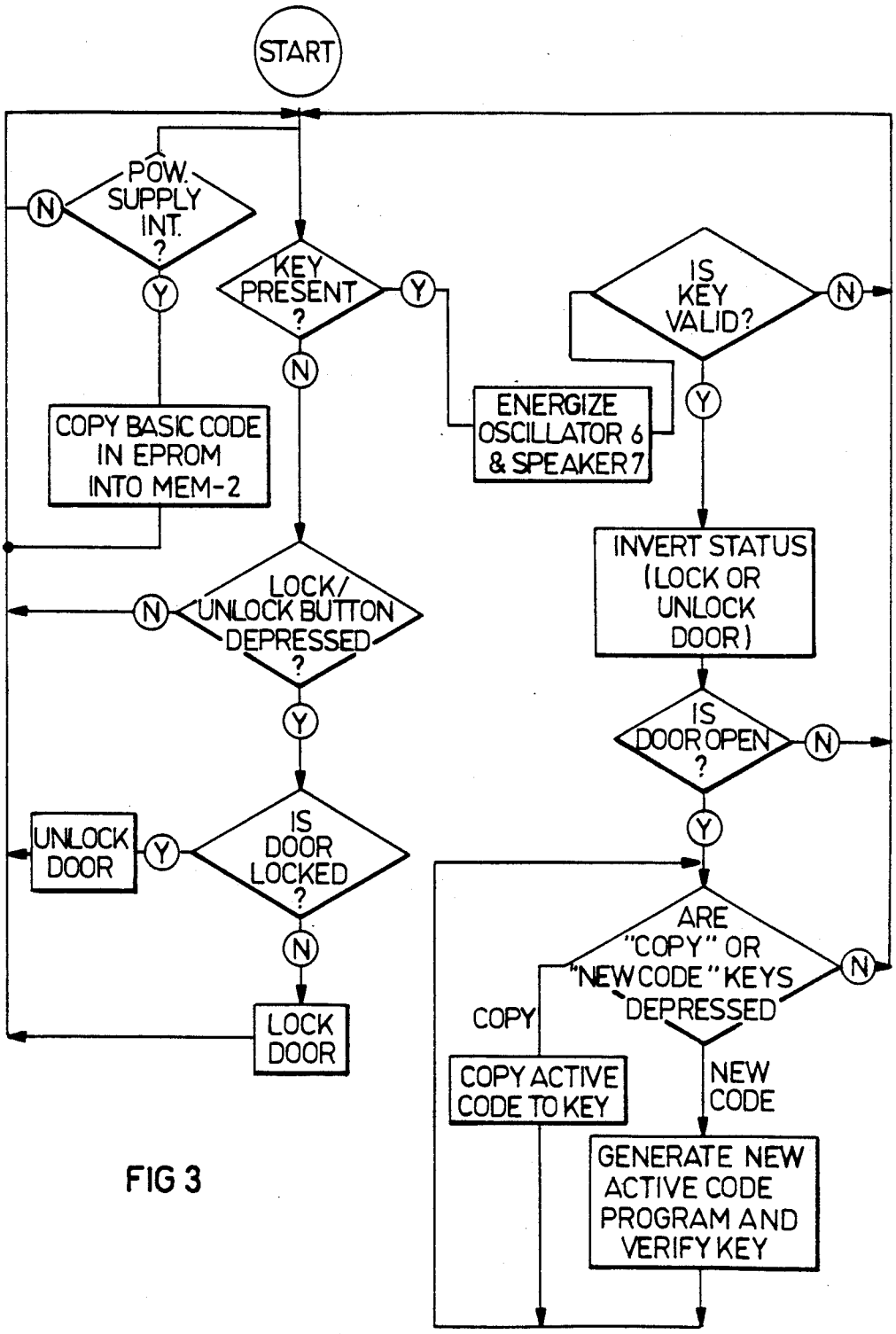
FIG. 3 is a flow diagram showing in a simplified manner the operation of the system.

FIG. 3 shows, in a simplified manner, how the system operates. The control system constantly monitors whether a key is present within the key receptacle 9. When no key is present, only the "lock/unlock" pushbutton switch 11 within the building is functional. Therefore, the system checks whether the "lock/unlock" pushbutton switch 11 is depressed and, if not, control is returned to the start of the control loop. As soon as the "lock/unlock" pushbutton switch 11 is depressed, the system checks the status of the lock mechanism, as explained above. If the door is locked, the control circuit sends a suitable instruction to the motor 34 so as to unlock the door and, conversely, if the lock mechanism is unlocked, the control circuit causes it to be locked. Thus, the control loop checks the status of the lock mechanism and then inverts it. Having done this, control is returned to the start of the control loop.

As soon as a key is inserted into the key receptacle 9, the control loop checks whether the key is valid. If not, control is returned to the start of the control loop, and the operator has an opportunity to insert another key. In one prefered embodiment wherein several active key portions are coded, the said control loop will check for validity only the portion of the active code which is valid for the specific location. In a preferred embodiment (not shown in FIG. 3) if an invalid key is inserted three times consecutively into the key receptacle 9, the alarm system 14 is energised automatically. If the key is valid, the control system checks the status of the lock mechanism and then inverts it. In this way a user may leave his premises and close the door, and then insert a valid key into the key receptacle 9 in order to lock the door automatically. On his return, inserting the key into the key receptacle 9 will automatically unlock the door.

In order to initiate the "copy" and "new code" functions, the door must be opened as detected by magnetic switch 42, and a valid key must be inserted into the key receptacle 9. Thus, the control loop is adapted to check whether the door is open and, if not, control is returned to the start of the control loop. If, on the other hand, the door is open, the system checks whether either the "copy" pushbutton switch 13 or the "new code" pushbutton switch 12 is depressed. If the "copy" pushbutton switch, is depressed, the active code stored within MEM-2 of the computer memory will then be copied to a key subsequently inserted into the key receptacle 9. This loop may then be repeated as many times as required by the user, so as to copy the active code to as many keys as required. Since this loop is activated only when a valid key is present within the key receptacle 9, when this loop is first executed, the active code is copied to the valid key containing that code. However, the "copy" loop may be repeated without checking that a valid key is inserted into the key ring receptacle 9. Thus, the instructions within the "copy" loop may then be repeated with blank or invalid keys in order to achieve the desired result.

When the "new code" pushbutton switch 12 is depressed, the control system automatically generates a new active code which is stored within the microprocessor memory MEM-2. This active code is then written to the valid key within the key receptacle 9 by means of a serial data communications line connecting the microprocessor 1 to the key. In order to check the integrity of data transfer, the "new code" loop also verifies that the code stored within the key memory corresponds to the active code stored within the microprocessor memory before allowing further "copy" or "new code" functions to be executed. In one prefered embodiment the new code generated and the program are dependent on the location, so that only one portion of the code that is valid for the specific location is rewritten.

As further shown in FIG. 3, when a key 10 is inserted into the key receptacle 9, the local oscillator 6 produces an audible tone on the loudspeaker 7 which continues until the key is removed from the key receptacle 9. This audible tone both acknowledges insertion of a key into the key receptacle, and acts as an audible warning to caution the user to remove his key from the key receptacle before entering or leaving the premises. In a similar manner, the local oscillator 6 may be adapted to produce audible tones of variable frequency through the loudspeaker 7, according to which of the three selector pushbutton switches is pressed.

In a preferred embodiment, the active code is stored within 256 bits of memory thereby providing a total number of possible active codes in the order of $10^{70}$. This is greatly in excess of the number of permutation offered by prior art systems which require the user to remember his own personal identity code. Thus, the invention provides a flexible, high-security, integrated security lock which may easily be protected by an external alarm system, and enables a user to program his key with a highly secure random code and also to produce copies of the key thus produced.

What is claimed is:

1. An electronic door locking apparatus, comprising:

a key containing a first memory for storing a first code; and an electronic lock carried by the door and having a receptacle for receiving said key and for reading said first code, a locking mechanism actuatable to a locking or unlocking condition, and a control system for controlling said locking mechanism in response to the insertion of said key into said receptacle;

said control system comprising: a second memory for storing a second code; a New-Code control member disposed inwardly of the door and actuatable by the user when a new code is to be generated; comparison means for comparing the first code stored in said first memory of the key with the second code stored in said second memory of the control system, to determine whether a match exists; key detector means for detecting whether a key is inserted into said receptacle; door detector means for detecting whether the door is open or closed; and a processor programmed so as to be effective, if (a) said key is inserted into said receptacle as detected by said key detector means, (b) the first code stored in said first memory of the inserted key matches the second code stored in said second memory of the control system as determined by said comparison means, (c) the door is open as determined by said door detector means, and (d) the New-Code control member is actuated, then to generate a new code and to store same in the first memory of the inserted key and in said second memory of the control system.

2. The apparatus according to claim 1, wherein said control system further includes: a Copy-Code control member disposed inwardly of the door and actuatable by the user when the second code in the memory of the control system is to be copied into the memory of another key;

said processor being further programmed so as to be effective, if (a) a key is inserted into said receptacle as detected by said key detector means, (b) the first code stored in the first memory of the inserted key matches the second code stored in said second memory of the control system as determined by said comparison means, (c) the door is open as determined by said door detector means, and (d) the Copy-Code control member is actuated, then to copy the second copy stored in said second memory of the control system into the first memory of another key subsequently inserted into said receptacle.

3. The apparatus according to claim 1, wherein said control system further includes: lock detector means for detecting whether the locking mechanism is in its locking or unlocking position, and a Lock-Unlock control member disposed inwardly of the door and actuatable by the user;

and wherein said processor is further programmed so as to be effective when the Lock-Unlock control member has been actuated, to actuate said locking mechanism to its locking condition if then in the unlocking condition, or to its unlocking condition if then in the locking condition.

4. The apparatus according to claim 1, wherein said control system further includes a read-only-memory storing a basic code;

and wherein said processor is further programmed so as to be effective, upon the interruption and restoration of power to the control system, automatically to store said basic code in said second memory of the control system.

5. The apparatus according to claim 1, wherein said locking mechanism comprises:

at least one locking bolt carried by the door and receivable in a socket in the door frame, a rotary motor carried by the door, and a transmission coupling said rotary motor to said locking bolt to drive it into or out of said socket.

6. The apparatus according to claim 5, wherein said transmission has a portion disposed in a window accessible from the inner side of the door to permit manual actuation of the locking bolt into or out of said socket.

7. The apparatus according to claim 5, wherein said locking mechanism comprises a plurality of locking bolts coupled to a drive wheel rotated by said rotary motor.

8. An electronic door locking apparatus, comprising:

a key containing a first memory for storing a first code; and an electronic lock carried by the door and having a receptacle for receiving said key and for reading said first code, a locking mechanism actuatable to a locking or unlocking condition, and a control system for controlling said locking mechanism in response to the insertion of a key into said receptacle;

said control system comprising: a second memory for storing a second code; comparison means for comparing the first code stored in said first memory of the key with the second code stored in said second memory of the control system, to determine whether a match exists; key detector means for detecting whether a key is inserted into said receptacle; door detector means for detecting whether the door is open or closed; a Copy-Code control member disposed inwardly of the door and actuatable by the user when the second code stored in the memory of the control system is to be copied into the memory of another key; and a processor programmed so as to be effective, if (a) a key is inserted into said receptacle as detected by said detector means, (b) the first code stored in said first memory of the inserted key matches the second code stored in said second memory of the control system as determined by said comparison means, (c) the door is open as determined by said door detector means, and (d) the Copy-Code control member is actuated, then to copy the second code stored in said second memory of the control system into the first memory of another key subsequently inserted into said receptacle.

9. The apparatus according to claim 8, wherein said control system further comprises a New-Code control member disposed inwardly of the door and actuatable by the user when a new code is to be generated;

and wherein said processor is further programmed so as to be effective if (a) a key is inserted into said receptacle, (b) the first code stored in the memory of the inserted key matches the second code stored in said second memory of the control system as determined by said comparison means, (c) the door is open, and (d) the New-Code control member is actuated, then to generate a new code and to store same in said first memory of the inserted key and in said second memory of the control system.

10. The apparatus according to claim 8, wherein said control system further includes: detector means for detecting whether the locking mechanism is in its locking or unlocking position; and a Lock-Unlock control member actuated by the user;

and wherein said processor is further programmed so as to be effective when the Lock-Unlock control member has been actuated, to actuate said locking mechanism to its locking condition if then in the unlocking condition, or to its unlocking condition if then in the locking condition.

11. The apparatus according to claim 8, wherein said control system further includes a read-only-memory storing a basic code;

and wherein said processor is further programmed so as to be effective, upon the interruption and restoration of power to the control system, automatically to store said basic code in said second memory of the control system.

12. The apparatus according to claim 8, wherein said locking mechanism comprises:

at least one locking bolt carried by the door and receivable in a socket in the door frame, a rotary motor carried by the door, and a transmission coupling said rotary motor to said locking bolt to drive it into or out of said socket.

13. An electronic door locking apparatus comprising:

a key containing a first memory for storing a first code; and an electronic lock carried by the door and having a receptacle for receiving said key and reading said first code, a locking mechanism actuatable to a locking or unlocking condition, and a control system for controlling said locking mechanism in response to the insertion of a key into said receptacle;

said control system comprising: a read-only memory storing a basic code; and a processor programmed so as to be effective upon the interruption and restoration of power to the control system automatically to store said basic code in said read-only memory of the control system;

said control system further comprising: a further memory for storing a second code; a New-Code control member disposed inwardly of the door and actuatable by the user when a new code is to be generated; comparison means for comparing the first code stored in said first memory of the key with the second code stored in said further memory of the control system, to determine whether a match exists; key detector means for detecting whether a key is inserted into said receptacle; door detector means for detecting whether the door is open or closed;

said processor being further programmed so as to be effective, if (a) said key is inserted into said receptacle as detected by said key detector means, (b) the first code stored in said first memory of the inserted key matches the second code stored in said further memory of the control system as determined by said comparison means, (c) the door is open as determined by said door detector means, and (d) the New-Code control member is actuated, then to generate a new code and to store same in the first memory of the inserted key and in said further memory of the control system.

14. The apparatus according to claim 13 wherein said control system further includes: a Copy-Code control member actuatable by the user when the second code in the memory of the control system is to be copied into the memory of another key;

said processor being further programmed so as to be effective, if (a) a key is inserted into said receptacle as detected by said key detector means, (b) the first code stored in the first memory of the inserted key matches the second code stored in the memory of said further memory of the control system as determined by said comparison means, (c) the door is open as determined by said door detector means, and (d) the Copy-Code control member is actuated, then to copy the second code stored in said further memory of the control system into the first memory of a key subsequently inserted into said receptacle.

15. The processor according to claim 13, wherein said control system further includes: lock detector means for detecting whether the locking mechanism is in its locking or unlocking position; and a Lock-Unlock control member actuated by the user;

and wherein said processor is further programmed so as to be effective when the Lock-Unlock control member has been actuated to actuate said locking mechanism to its locking condition if then in the unlocking condition, or to its unlocking condition if then in the locking condition.

16. The apparatus according to claim 13, wherein said locking mechanism comprises:

at least one locking bolt carried by the door and receivable in a socket in the door frame, a rotary motor carried by the door, and a transmission coupling said rotary motor to said locking bolt to drive it into or out of said socket.

17. The apparatus according to claim 16, wherein said transmission has a portion disposed in a window accessible from the inner side of the door to permit manual actuation of the locking bolt into or out of said socket.

18. The apparatus according to claim 16, wherein said locking mechanism comprises a plurality of locking bolts coupled to a drive wheel rotated by said rotary motor.

* * * * *